US008205618B2

(12) United States Patent
Berghash et al.

(10) Patent No.: US 8,205,618 B2
(45) Date of Patent: Jun. 26, 2012

(54) MOUTHGUARD

(75) Inventors: Robert Berghash, Williamsville, NY (US); Daniel D'Arcy, Lancaster, NY (US)

(73) Assignee: Shield Manufacturing, Inc., Tonawanda, NY (US)

( * ) Notice: Subject to any disclaimer, the term of this patent is extended or adjusted under 35 U.S.C. 154(b) by 449 days.

(21) Appl. No.: 12/075,185

(22) Filed: Mar. 10, 2008

(65) Prior Publication Data

US 2009/0223526 A1 Sep. 10, 2009

(51) Int. Cl.
*A61C 5/14* (2006.01)
*A61C 3/00* (2006.01)
*A61F 5/56* (2006.01)

(52) U.S. Cl. ..... 128/861; 128/859; 128/848; 128/862; 433/6

(58) Field of Classification Search ..... 128/861, 128/859, 848, 862; 433/6
See application file for complete search history.

(56) References Cited

U.S. PATENT DOCUMENTS

| | | | |
|---|---|---|---|
| D243,127 | S | 1/1977 | Farquharson |
| 4,041,937 | A | 8/1977 | Diaz |
| 4,044,762 | A | 8/1977 | Jacobs |
| 4,063,552 | A | 12/1977 | Going et al. |
| 4,114,614 | A | 9/1978 | Kesling |
| 4,337,765 | A | 7/1982 | Zimmerman |
| 4,471,771 | A | 9/1984 | Brown et al. |
| 4,502,478 | A | 3/1985 | Lifton |
| 4,640,273 | A | 2/1987 | Greene et al. |
| 4,738,259 | A | 4/1988 | Brown et al. |
| 4,765,324 | A | 8/1988 | Lake, Jr. |
| 4,781,709 | A | 11/1988 | Grubman |
| 4,791,941 | A | 12/1988 | Schaefer |
| 4,848,365 | A | 7/1989 | Guarlotti et al. |
| 4,955,393 | A | 9/1990 | Adell |
| 4,977,905 | A | 12/1990 | Kittelsen et al. |
| 4,979,516 | A | 12/1990 | Abraham, II |
| 5,016,649 | A | 5/1991 | Johnson |
| 5,031,638 | A | 7/1991 | Castaldi |
| 5,033,480 | A | 7/1991 | Wiley et al. |
| 5,063,940 | A | 11/1991 | Adell et al. |
| 5,082,007 | A | 1/1992 | Adell |
| 5,103,838 | A | 4/1992 | Yousif |
| 5,152,300 | A | 10/1992 | Horst |
| 5,152,301 | A | 10/1992 | Kittelsen et al. |
| 5,165,423 | A | 11/1992 | Fowler et al. |
| 5,174,284 | A | 12/1992 | Jackson |
| 5,203,351 | A | 4/1993 | Adell |
| 5,234,005 | A | 8/1993 | Kittelsen et al. |
| 5,235,991 | A | 8/1993 | Minneman |
| 5,277,203 | A | 1/1994 | Hays |
| D343,928 | S | 2/1994 | Kittelsen |

(Continued)

*Primary Examiner* — Patricia Bianco
*Assistant Examiner* — Victoria J Hicks
(74) *Attorney, Agent, or Firm* — Simpson & Simpson, PLLC

(57) ABSTRACT

The present invention is a mouthguard to be used in sports to protect the mouth and teeth from blows to the face and head. The mouthguard has a three layer laminate construction and is fabricated from thermoplastic material that may be softened in hot water to enable a user to form it to the contours of his or her mouth. The mouthguard is formed from an upper portion shaped into a channel with holes distributed on the channel floor and a lower platform with posts aligned to fit into the holes. A part of the posts extend from the upper portion to the platform to form gaps between the upper portion and the platform with the gaps acting as air cushions. In one embodiment, a strap is attached to the assembled mouthguard.

16 Claims, 18 Drawing Sheets

U.S. PATENT DOCUMENTS 5,293,880 A 3/1994 Levitt
5,318,043 A 6/1994 Burr et al.
5,320,114 A 6/1994 Kittelsen et al.
5,339,832 A 8/1994 Kittelsen et al.
5,353,810 A 10/1994 Kittelsen et al.
5,365,946 A 11/1994 McMillan
5,385,155 A 1/1995 Kittelsen et al.
5,406,963 A 4/1995 Adell
5,447,168 A 9/1995 Bancroft
5,462,067 A 10/1995 Shapiro
5,469,865 A 11/1995 Minneman
D368,329 S 3/1996 Parada
5,533,524 A 7/1996 Minneman
5,566,684 A 10/1996 Wagner
5,582,187 A 12/1996 Hussey
5,586,562 A 12/1996 Matz
5,636,379 A 6/1997 Williams
D382,965 S 8/1997 Wagner
5,692,523 A 12/1997 Croll et al.
5,718,240 A 2/1998 Dunlop
5,718,243 A 2/1998 Weatherford et al.
5,720,302 A 2/1998 Belfer
5,730,599 A 3/1998 Pak
5,746,221 A 5/1998 Jones et al.
5,785,052 A 7/1998 Johnson
5,794,627 A * 8/1998 Frantz et al. ..... 128/848
5,810,013 A 9/1998 Belfer
5,816,255 A 10/1998 Fishman et al.
5,823,193 A * 10/1998 Singer et al. ..... 128/848
5,921,241 A 7/1999 Belfer
5,931,164 A 8/1999 Kiely et al.
5,941,246 A 8/1999 Roopchand
5,954,500 A 9/1999 Spriggs
5,970,981 A 10/1999 Oched
6,003,515 A 12/1999 Maness
6,036,487 A 3/2000 Westerman
6,039,046 A 3/2000 Swartz et al.
6,076,526 A 6/2000 Abdelmessih
6,080,923 A 6/2000 Austin
6,082,363 A 7/2000 Washburn
6,092,524 A 7/2000 Barnes, Sr.
6,109,266 A 8/2000 Turchetti
D434,501 S 11/2000 Redhage
6,178,967 B1 1/2001 Barnes, Sr.
6,241,518 B1 6/2001 Sullivan
6,257,238 B1 7/2001 Meah
6,302,110 B1 10/2001 Yoshida
6,314,960 B1 11/2001 Vines
6,318,371 B1 11/2001 Tyszkiewicz
6,321,752 B1 11/2001 Spottiswoode
D452,011 S 12/2001 Redhage
6,397,848 B1 6/2002 Kagekata et al.
6,491,037 B1 12/2002 Mortenson
6,491,521 B1 12/2002 Fowler, Jr.
6,494,210 B1 12/2002 Mams
6,505,626 B2 1/2003 Kittelsen et al.
6,505,627 B2 1/2003 Kittelsen et al.
6,505,628 B2 1/2003 Kittelsen et al.
6,508,251 B2 1/2003 Kittelsen et al.
6,510,853 B1 1/2003 Kittelsen et al.
D473,976 S 4/2003 Wilkens
6,584,978 B1 7/2003 Brett et al.
6,588,430 B2 7/2003 Kittelsen et al.
6,637,436 B2 10/2003 Farrell
6,675,804 B1 1/2004 Pivovarov
6,675,806 B2 1/2004 Kittelsen et al.
6,675,807 B2 1/2004 Kittelsen et al.
6,675,808 B2 1/2004 Karasic
6,691,710 B2 2/2004 Kittelsen et al.
D493,578 S 7/2004 Manzo et al.
D493,920 S 8/2004 Hillman
6,790,036 B2 9/2004 Graham
6,805,127 B1 10/2004 Karasic
D500,895 S 1/2005 Manzo et al.
6,851,424 B2 2/2005 Scopton
D502,787 S 3/2005 Liu
6,886,567 B1 5/2005 Liu
D509,028 S 8/2005 Farrell
6,932,087 B1 8/2005 Burns
6,932,088 B1 8/2005 Berghash
6,935,857 B1 8/2005 Farrell
6,941,952 B1 9/2005 Rush, III
6,951,678 B2 10/2005 Takeshita et al.
6,986,354 B1 1/2006 Burns
D520,189 S 5/2006 Hillman
D523,994 S 6/2006 Manzo
D525,749 S 7/2006 Manzo et al.
D526,093 S 8/2006 Manzo et al.
D526,095 S 8/2006 Manzo et al.
D527,848 S 9/2006 Manzo et al.
D530,863 S 10/2006 Manzo et al.
7,128,072 B2 10/2006 Bancroft
D532,559 S 11/2006 Manzo et al.
D533,686 S 12/2006 Hillman
D536,834 S 2/2007 Hillman
D537,210 S 2/2007 Hillman
D537,572 S 2/2007 Hillman
7,178,520 B2 2/2007 Scopton
7,182,086 B2 2/2007 Fujieda et al.
D537,986 S 3/2007 Manzo et al.
D537,987 S 3/2007 Manzo et al.
D539,484 S 3/2007 Hillman
D541,481 S 4/2007 Farrell
7,210,483 B1 5/2007 Lesniak et
2002/0134391 A1 9/2002 Karasic
2002/0139376 A1 10/2002 Waddy
2002/0144687 A1 10/2002 Kittelsen et al.
2002/0144688 A1 10/2002 Kittelsen et al.
2002/0144689 A1 10/2002 Kittelsen et al.
2002/0144690 A1 10/2002 Kittelsen et al.
2002/0144691 A1 10/2002 Kittelsen et al.
2002/0144692 A1 10/2002 Kittelsen et al.
2002/0144693 A1 10/2002 Kittelsen et al.
2002/0144694 A1 10/2002 Kittelsen et al.
2003/0019497 A1 1/2003 Farrell
2003/0056796 A1 3/2003 Conklin
2003/0075184 A1 4/2003 Persichetti
2003/0089371 A1 5/2003 Robertson et al.
2003/0101999 A1 6/2003 Kittelsen et al.
2003/0111083 A1 6/2003 Bancroft
2003/0136416 A1 7/2003 White
2003/0145863 A1 8/2003 Fischer et al.
2003/0205234 A1 11/2003 Bardach et al.
2003/0230311 A1 12/2003 Raymond
2004/0025887 A1 2/2004 Scopton
2004/0103905 A1 6/2004 Farrell
2004/0107970 A1 6/2004 Kittelsen et al.
2004/0144393 A1 7/2004 Conklin
2004/0149292 A1 8/2004 Fujieda et al.
2004/0154625 A1 8/2004 Foley
2004/0154626 A1 8/2004 Washburn et al.
2004/0244805 A1 12/2004 Cook et al.
2004/0250817 A1 12/2004 Kittelsen et al.
2004/0250818 A1 12/2004 Cook et al.
2005/0109348 A1 5/2005 Liu
2005/0115571 A1 6/2005 Jacobs
2005/0241650 A1 11/2005 Lombardi
2005/0284489 A1 12/2005 Ambis, Jr.
2006/0065277 A1 3/2006 Jacobs
2006/0112962 A1 6/2006 Tebbutt et al.
2006/0130851 A1 6/2006 Mathias
2006/0157062 A1 7/2006 Raymond
2006/0219250 A1 10/2006 Farrell
2006/0237020 A1 10/2006 Morgan et al.
2006/0278238 A1 12/2006 Borody
2007/0023055 A1 2/2007 Roth
2007/0079835 A1 4/2007 Croll
2007/0084472 A1 4/2007 Berghash

* cited by examiner

MOUTHGUARD

FIELD OF THE INVENTION

The present invention relates to the field of safety, more particularly to the prevention and/or reduction of damage caused by impact injuries. More specifically, the invention pertains to the use of mouthguards in the field of oral and dental safety.

BACKGROUND OF THE INVENTION

Mouthguards are used in a variety of environments to prevent or reduce injuries to the inside of the mouth, teeth, and the jaw by absorbing some or all of the impact of blows to the face and head. The use of mouthguards is especially well known in such sports as football, hockey, boxing and other contact sports in which blows to the face and head are expected. Within the past few years, the use of mouthguards has extended to other sports such as basketball in which accidental blows can occur. Mouthguards can prevent concussions, tissue damage to the mouth, loosening of teeth, and misalignment and dislocations of the temporal-mandibular joint.

Two main factors are important in fabricating a mouthguard. First, the mouthguard must be able to absorb the shock of blows to the head, face, and teeth to prevent the injuries described above. Second, the mouthguard must be comfortable in the user's mouth. These two factors can often be conflicting as harder more rigid materials may absorb blows more effectively but are more uncomfortable when worn as they do not easily conform to the contours of the mouth. Conversely, a softer mouthguard may be more comfortable but less able to absorb blows sufficiently to prevent injuries. In addition, it is important to shape the mouthguard to allow the user to breath easily and without obstruction when playing a particular sport and to enable a user to easily keep the mouthguard in his or her mouth.

Kittelsen, et al. are inventors of a family of patents disclosing a mouthguard in which a nonsoftenable frame is covered by a skin of softenable substance. U.S. Pat. Nos. 6,588,430, 6,691,710, and 6,675,807 all disclose a mouthguard that also includes a detached lower part with projections that fit into aligned holes in the upper portion. The mouthguard is formed by placing it in boiling water to soften and then biting down on the guard. One drawback is that the softenable material is only a skin and thus may not be thick enough to both provide protection from impact and still be comfortable to wear.

Therefore, there remains in the field a need for a mouthguard fabricated from thermoplastic materials that can be softened and molded by the user of the mouthguard.

SUMMARY OF THE INVENTION

The present invention broadly comprises a mouthguard that comprises an upper portion in the form of a u-shaped channel having an inner wall, an outer wall, and a floor with the floor of the u-shaped channel defining a plurality of holes, a lower u-shaped platform in the form of a u-shaped base having a plurality of posts distributed on the u-shaped base and extending therefrom, and a filler material molded to the inside the u-shaped channel of the upper portion. Each of the plurality of posts is aligned with one of the plurality of holes such that at least a portion of the length of each of the posts extends through the aligned slot or hole when the lower portion is joined with the upper portion. In one embodiment, the mouthguard includes an attachment strap.

One object of the present invention is to provide a mouthguard having a three layer laminate construction.

A second object of the present invention is to supply a mouthguard that possesses at least one air cushion.

A third object of the present invention is to disclose a mouthguard in which all the materials of construction are softened and become moldable when dipped into heated water.

An additional object of the present invention is to provide a mouthguard that can be formed with or without a fixedly attached strap.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF PREFERRED EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Figure 1:
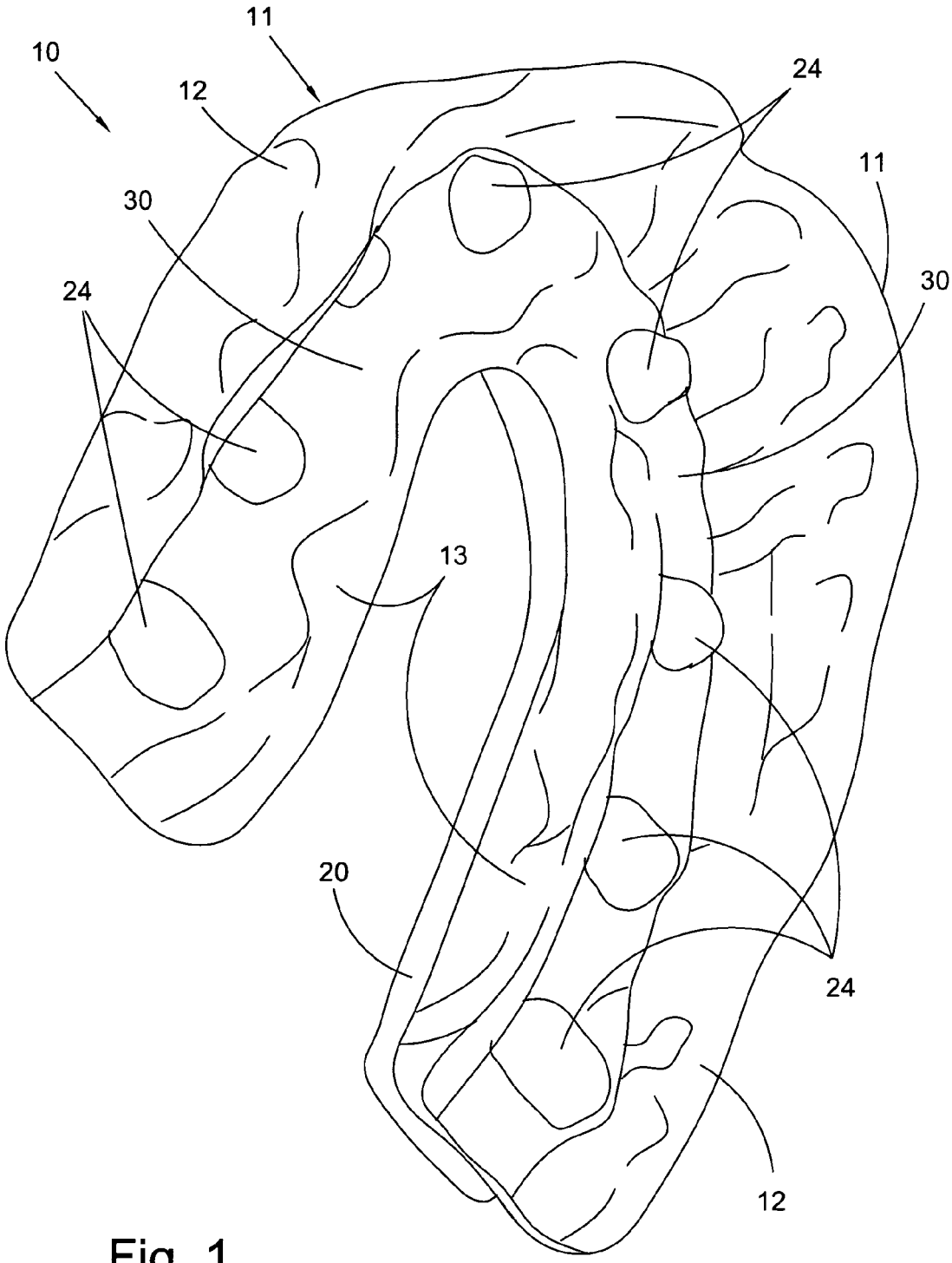
FIG. 1 is a top perspective of the mouthguard of the present invention.

Adverting to the drawings, FIG. 1 is a top perspective view of mouthguard 10 of the present invention. FIG. 1 depicts mouthguard 10 in an assembled condition without an attachment strap. Upper portion 11 is a u-shaped channel that includes outer wall 12 and inner wall 13 connected to floor 14 (not seen in FIG. 1) on the outer perimeter and inner perimeter, respectively, to form an integral unit. Walls 12 and 13 may each extend as one continuous wall around floor 14 or may each comprise two or more walls distributed around floor 14. Preferably, walls 12 and 13 and floor 14 are joined into an integral unit during a suitable molding process. Such molding processes are well known to those with skill in the art.

Mouthguard 10 also comprises lower u-shaped platform 20 seen attached to the bottom of upper portion 11. At least part of the length of posts 24 extends through holes 18 (not seen in FIG. 1). Filler material 30 is molded into the inside of upper portion 11. Filler 30, upper portion 11, and platform 20 together form a three layer laminate device.

Figure 2:
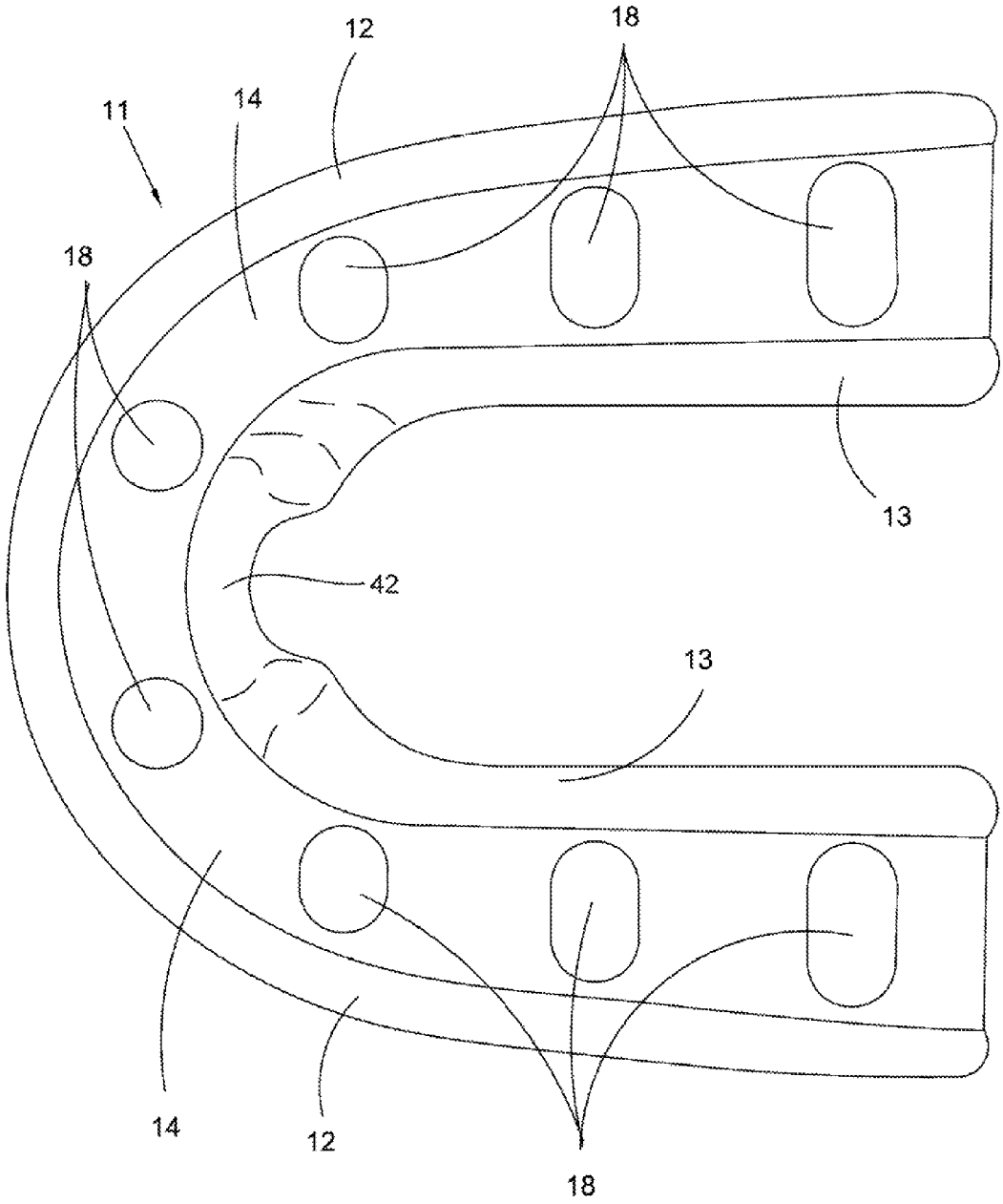
FIG. 2 is a top view of the upper portion of the mouthguard of the present invention.

FIG. 2 is a top view of upper portion 11 of mouthguard 10 before assembly with platform 20 and before addition of filler material 30. U-shaped floor 14 is seen extending the length of upper portion 11. Floor 14 is flanked on either side by outer wall 12 and inner wall 13. In the embodiment shown, inner wall 13 comprises two walls that extend from the end of each leg of the "U" and taper toward floor 14 near the start of the curve of the u shape. As explained below, in one embodiment, a groove between each of inner walls 13 forms part of a header orifice. As explained below, groove 42 is configured to receive strap 40 when mouthguard 10 is finally assembled. In an alternate embodiment, inner wall 13 may extend as a single wall around the inner perimeter of floor 14 with groove 42 absent from floor 14. Holes 18 are defined by floor 14.

Figure 3:
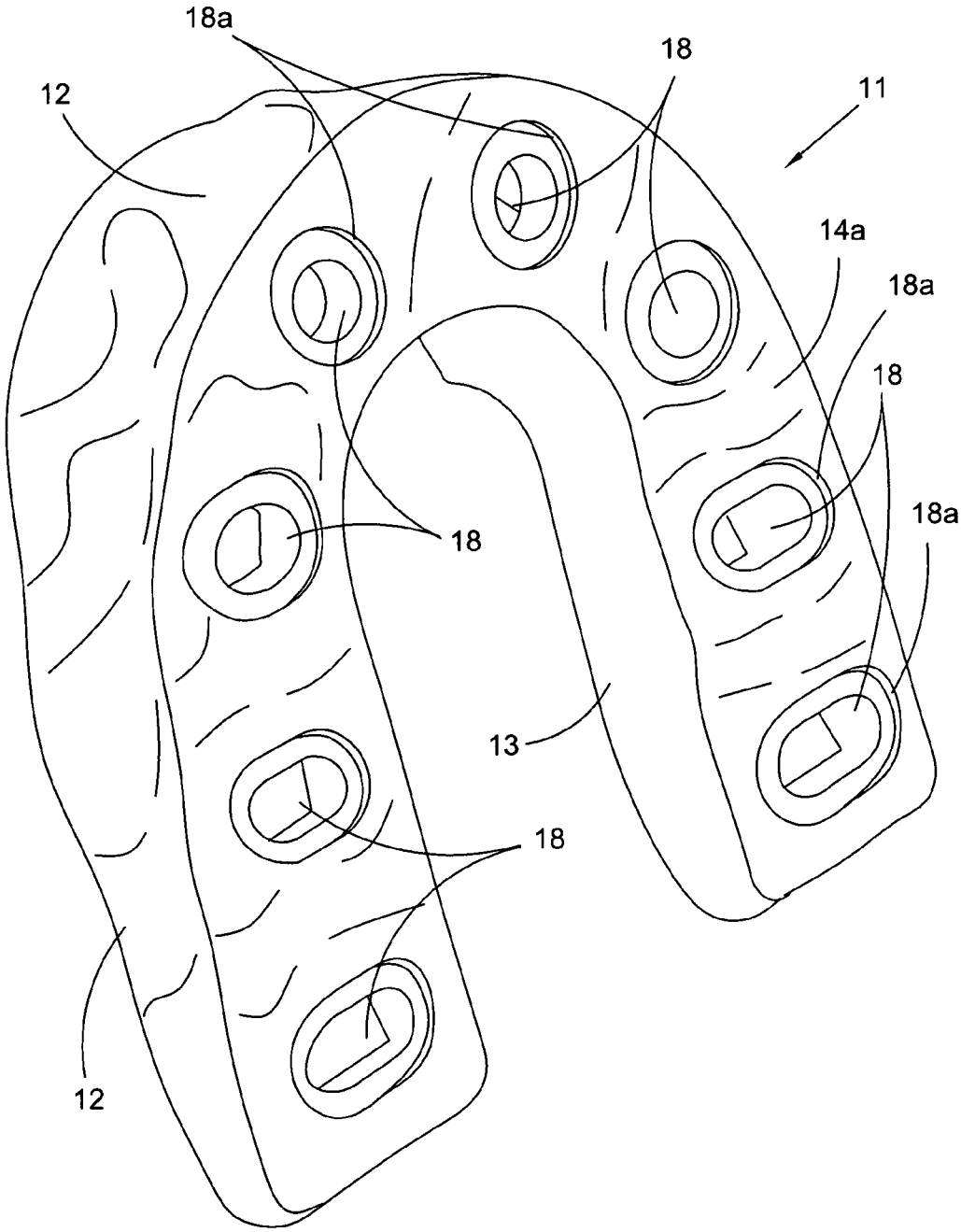
FIG. 3 is a bottom perspective view of the upper portion showing the grooves around the perimeter of the holes defined by the floor of the upper portion.

FIG. 3 is a bottom perspective view of upper portion 11. Holes 18 extend through floor 14. In a preferred embodiment, at least one perimeter groove 18*a* is formed into bottom surface 14*a* to surround the perimeter of each hole 18. In the embodiment shown, holes 18 are shaped into round orifices or oval shaped slots and grooves 18*a* are around each hole 18.

Figure 4:
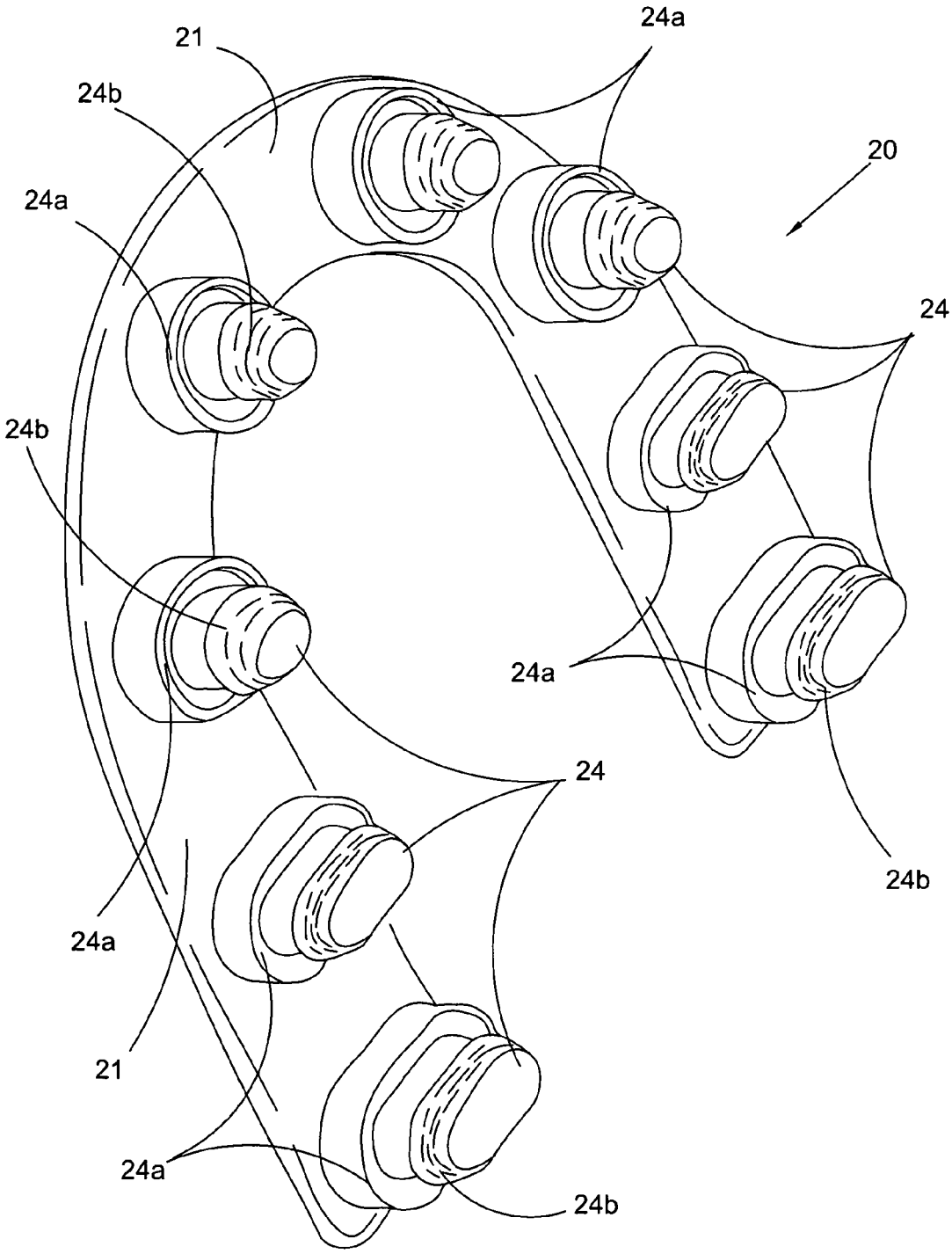
FIG. 4 is a top perspective view of the platform of the mouthguard of the present invention.
Figure 6:
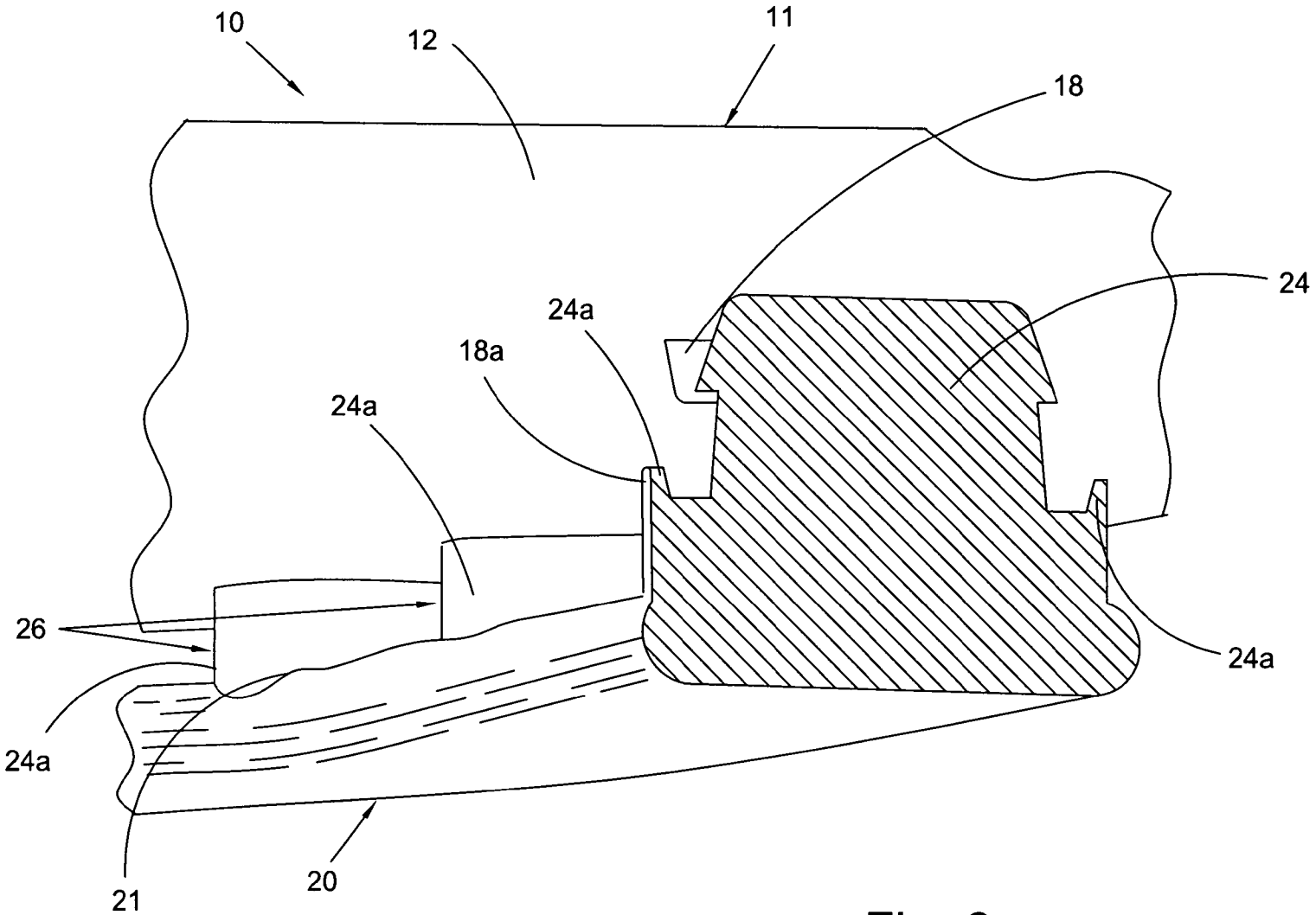
FIG. 6 is a cross section view of a portion of the assembled mouthguard through a post pressed into a hole of the upper portion of the mouthguard.

FIG. 4 is a top perspective view of platform 20. Platform 20 is also u-shaped similar to upper portion 11. U-shaped base 21 supports a plurality of posts 24 distributed around base 21. It is readily seen that posts 24 are shaped to fit into a corresponding hole 18 in upper portion 11 as described below. In a preferred embodiment, the upper ends 24*b* of posts 24 are tapered, while the bottom portion is substantially straight. More preferably, undercuts 24*a* are in direct contact with platform 20 and extend from platform 20 to surround posts 24 and are sized and shaped to fit into grooves 18*a* on the underside of upper portion 11. As seen in FIG. 4, each of the undercuts 24*a* is shorter than the post 24 that it surrounds as measured from the u-shaped base 21. This is also seen in FIG. 6 which shows the top of post 24 as higher than the top of undercut 24*a* as measured from u-shaped base 21.

Figure 5:
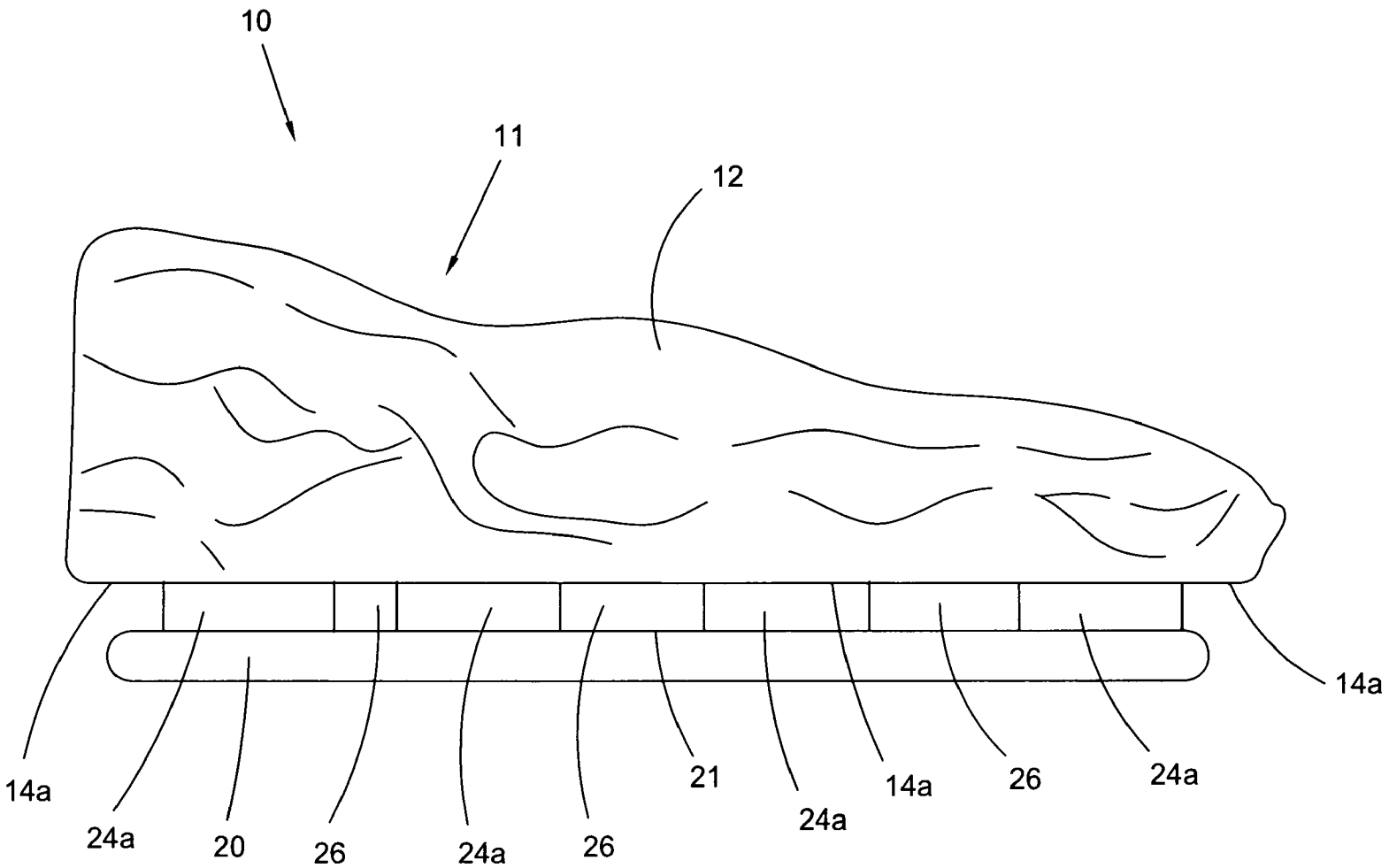
FIG. 5 is a side view of the assembled mouthguard of the present invention.

FIG. 5 is a side view of assembled mouthguard 10. Undercuts 24*a* are seen extending from base 21 to bottom surface 14*a* of upper portion 11. In the embodiment shown, each of posts 24 is aligned with one of holes 18. The assembly of mouthguard 10 is performed by pressing posts 24 of platform 20 into holes 18 of upper portion 11. Preferably, the shape of each post 24 conforms to the shape of corresponding (aligned) hole 18. For example, as seen in FIGS. 2-4, the round posts 24 are pressed into round orifices 18, while oval posts 24 are pressed into oval slots 18. While mouthguard 10 may be formed using posts 24 without undercuts 24*a*, preferably undercuts 24*a* are shaped to fit into corresponding grooves 18*a*. When pressed together, platform 20 is attached to upper portion 11. FIG. 6 is a cross section through a post 24 pressed into hole 18 with undercut 24*a* fitting into groove 18*a*.

Also seen in FIG. 5 is the plurality of gaps 26 formed between undercuts 24*a* or, alternatively, posts 24. Each gap 26 is defined by bottom surface 14*a*, base 21, and two succeeding undercuts 24*a* or posts 24. By succeeding is meant posts 24 or undercuts 24*a* that follow immediately in sequence in distribution around platform 20. Gaps 26 act as air cushions between upper portion 11 and platform 20 that help to dissipate and lessen the force of a blow to the head or face.

Figure 7:
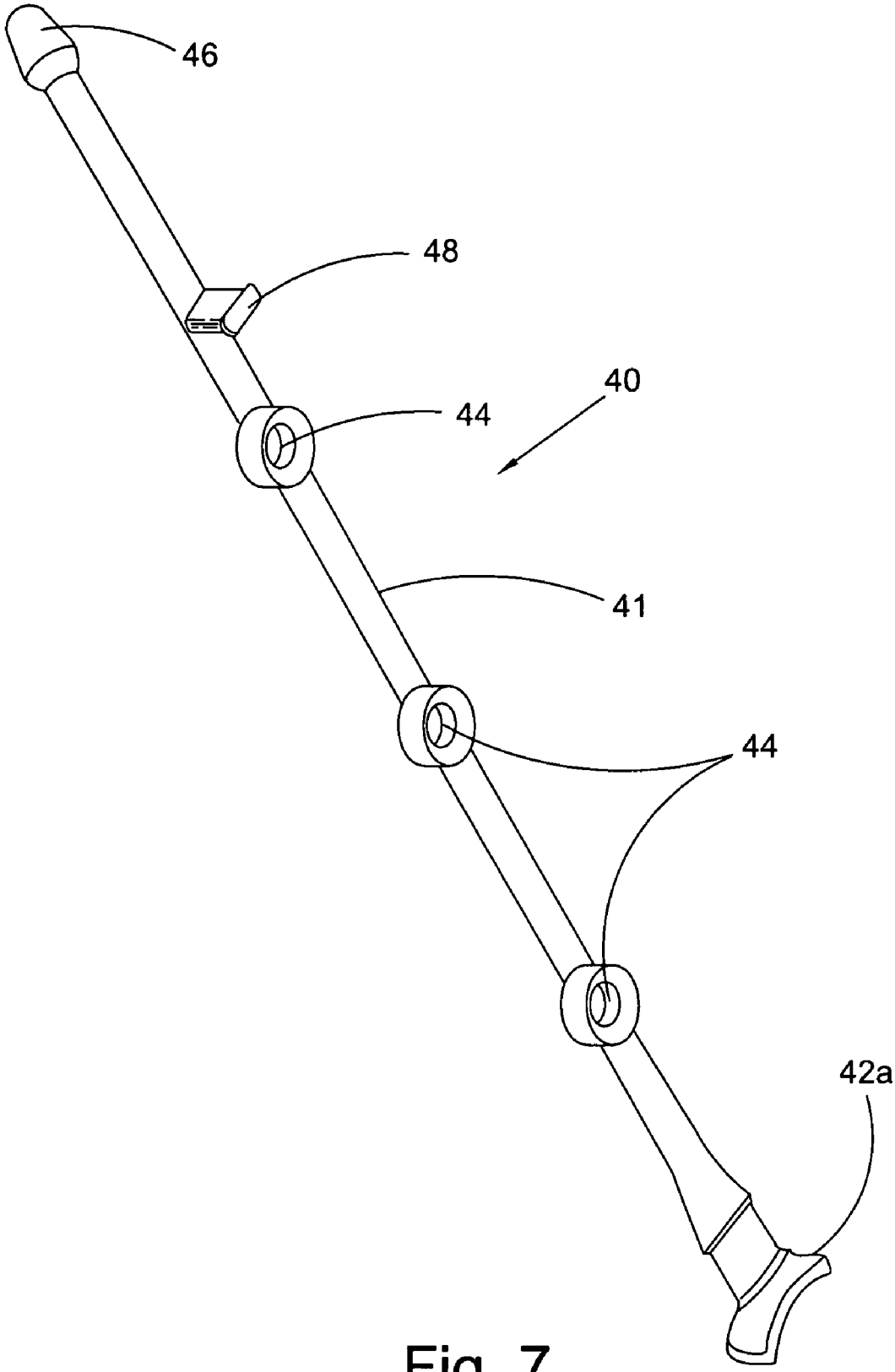
FIG. 7 is a top perspective view of a strap to be used to attach the mouthguard to a helmet.

FIG. 7 is a top perspective view of strap 40. As described below, in an alternate embodiment, strap 40 is attached to mouthguard 10 to enable mouthguard 10 to be easily accessible to the user by attaching it to a helmet such as a football helmet or lacrosse helmet. Header 42*a* is positioned at one end of strap 40. Leader 46 is at the end opposite of header 42*a*. Strap 40 defines a plurality of strap holes 44. In one embodiment of strap 40, lug 48 is positioned on strap 40 to be removably pressed into one of receiving holes 44 when the strap is folded for packaging. Strap 40 may be attached to helmet by wrapping it around a helmet face mask and inserting leader 46 into one of strap holes 44.

In one embodiment of mouthguard 10, header 42*a* fits into groove 42 on platform 20. When platform 20 is pressed together with upper portion 11, head 42*a* is trapped or wedged between upper portion 11 and platform 20 thereby attaching strap 40 to mouthguard 10. When the strap-mouthguard assembly is placed in boiling or near boiling water, as described below, strap 40 becomes fixedly attached to mouthguard 10 after the user bites down on the softened mouthguard.

Figure 8:
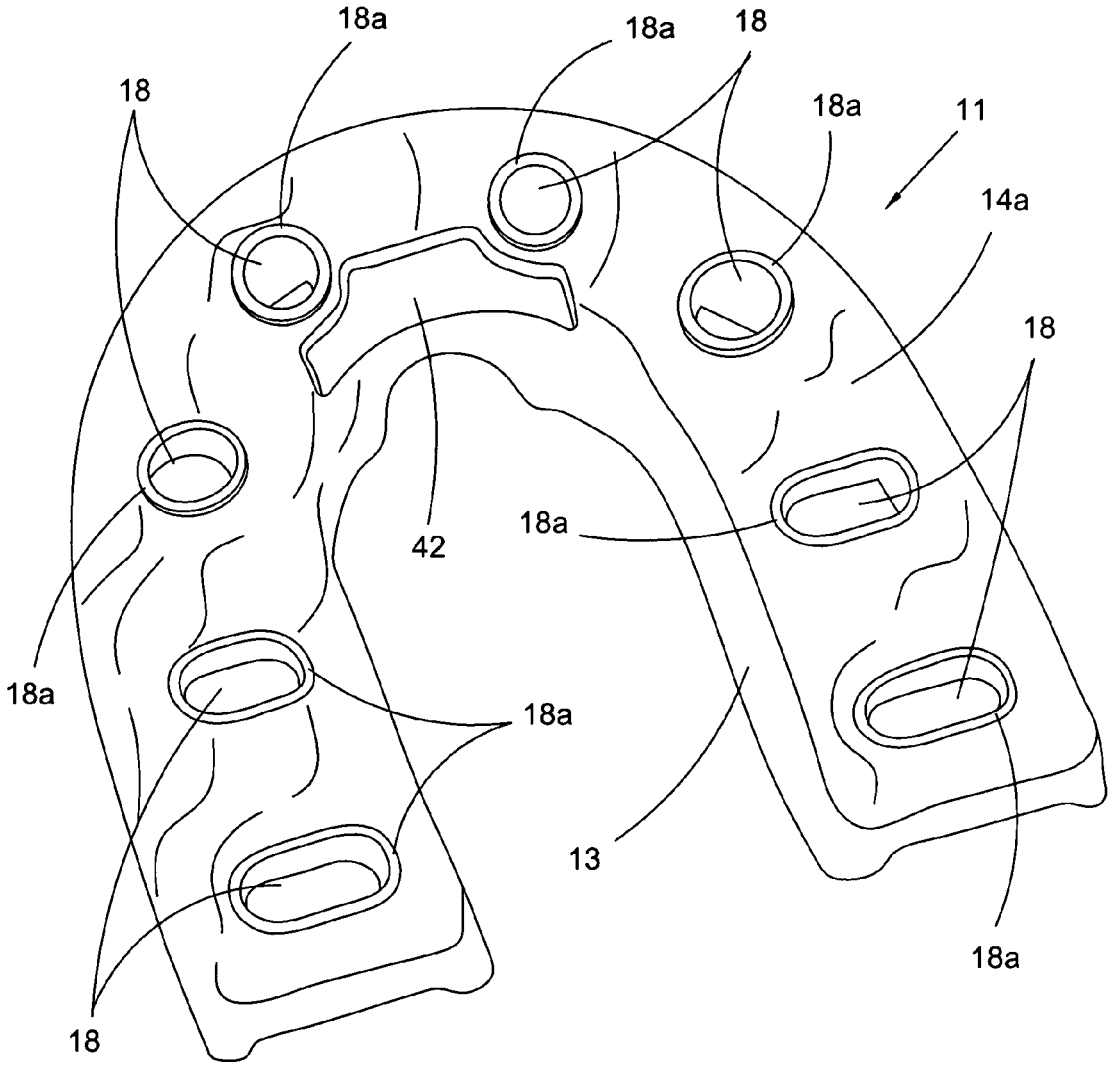
FIG. 8 is a bottom perspective view of an alternate embodiment of the upper portion of the mouthguard of the present invention.

FIG. 8 is a bottom perspective view of an alternate embodiment of upper portion 11. Groove 42 is formed at the bottom of the curve of the u-shaped upper portion. Most preferably, the outline of groove 42 possesses the same shape and size as header 42*a* of strap 40 to allow for a snug fit of header 42*a* into groove 42.

Figure 9:
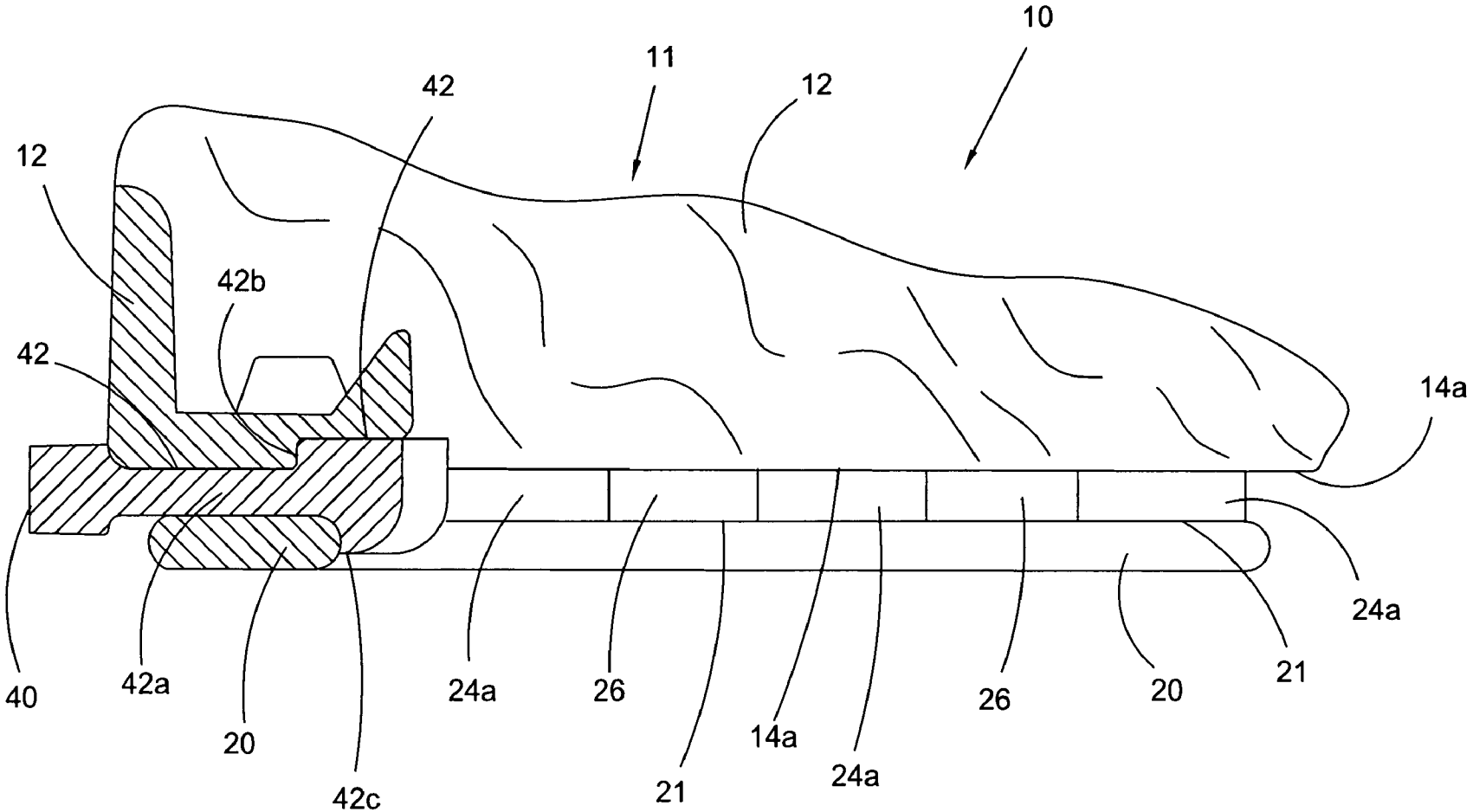
FIG. 9 is a cross section view of the alternate embodiment of the mouthguard of the present invention showing the strap attached to the mouthguard between the upper portion and the bottom platform.

FIG. 9 is a cross section view of the alternate embodiment of mouthguard 10 showing strap 40 attached to mouthguard 10. Header 42*a* is seen positioned in groove 42 and pressed between wall 12 and platform 20. Shoulders 42*b* and 42*c* rest against complementary shoulders in header orifice 42 and platform 20 to hold header 42*a* in place.

To assemble mouthguard 10 and customize it to a particular user's mouth cavity, holes 18 of upper portion 11 and posts 24 of platform 20 are aligned and the two pieces are pressed together so that at least part of the length of each of posts 24 extends through holes 18 and, in a preferred embodiment, undercuts 24*a* fit snugly into grooves 18*a*. Assembled mouthguard 10 is then dipped into hot water. Preferably, the water is brought to a boil after which the heat is removed from the water for about 30 seconds. Assembled mouthguard 10 is then held in the "near boiling" water for about 30 seconds. After shaking off the excess water, the user bites into the mouthguard. Because the boiling water presoftens mouthguard 10, it will form around the wearer's particular upper jaw and bite configuration. In addition, the wearer may suck on mouthguard 10 while biting to remove air from the softened material.

In shaping the embodiment that includes strap 40, upper portion 11 and platform 20 are pressed together as described above. Before placing assembled mouthguard 10 into the boiling or near boiling water, strap 40 is inserted through groove 42 from the inside of the curve of the u-shaped mouthguard 10 so that header 42*a* rests in groove 42 and leader 46 extends from mouthguard 10. Using strap 40 as a handle, mouthguard 10 is dipped into the boiling or near boiling water for about 30 seconds. Excess water is then shaken off after which the wearer bites down on the softened mouthguard 10 to form it into the shape of the wearer's mouth. Because header 42*a* is softened with upper portion 11 and platform 20, upper portion 11 and platform 20 are molded around header 42*a* to fixedly or permanently attach strap 40 to mouthguard 10.

Figure 10:
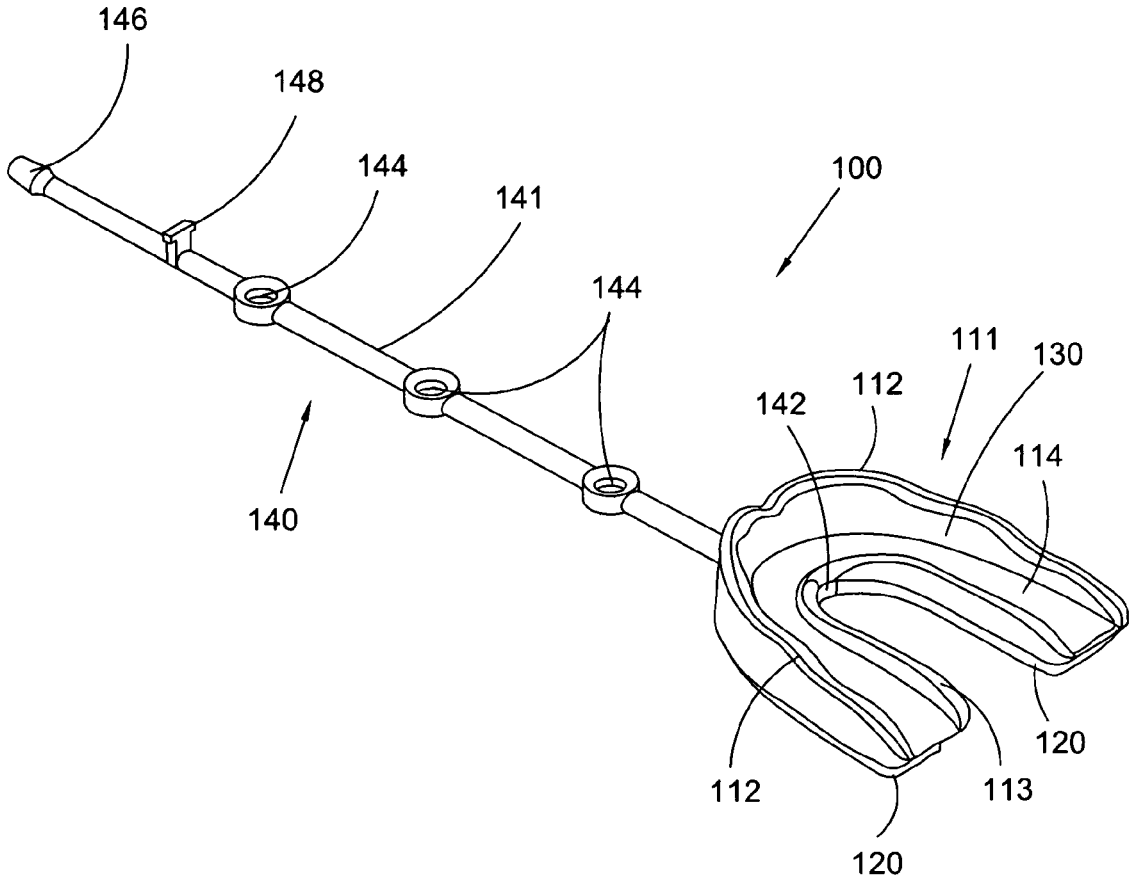
FIG. 10 is a top perspective view of an alternate embodiment of the mouthguard of the present invention.

FIG. 10 is a top perspective view of a second embodiment 100 of the mouthguard of the present invention. Upper portion 111 is seen attached to strap 140. Upper portion 111 is formed into a u-shaped channel including outer wall 112, inner wall 113, and floor 114. Filler material 130 covers floor 114 and posts 124 (not seen in FIG. 10). Filler material 130 is molded into the inside of upper portion 111. Filler 130, upper portion 111, and platform 120 together form a three layer laminate device. In some embodiments, posts 124 will be visible through filler 130 depending on the filler material used. As explained below, platform 120 is attached to upper portion 111 in a manner similar to assembled mouthguard 10. A portion of strap header 142 is seen at the curve portion of mouthguard 100.

Figure 11:
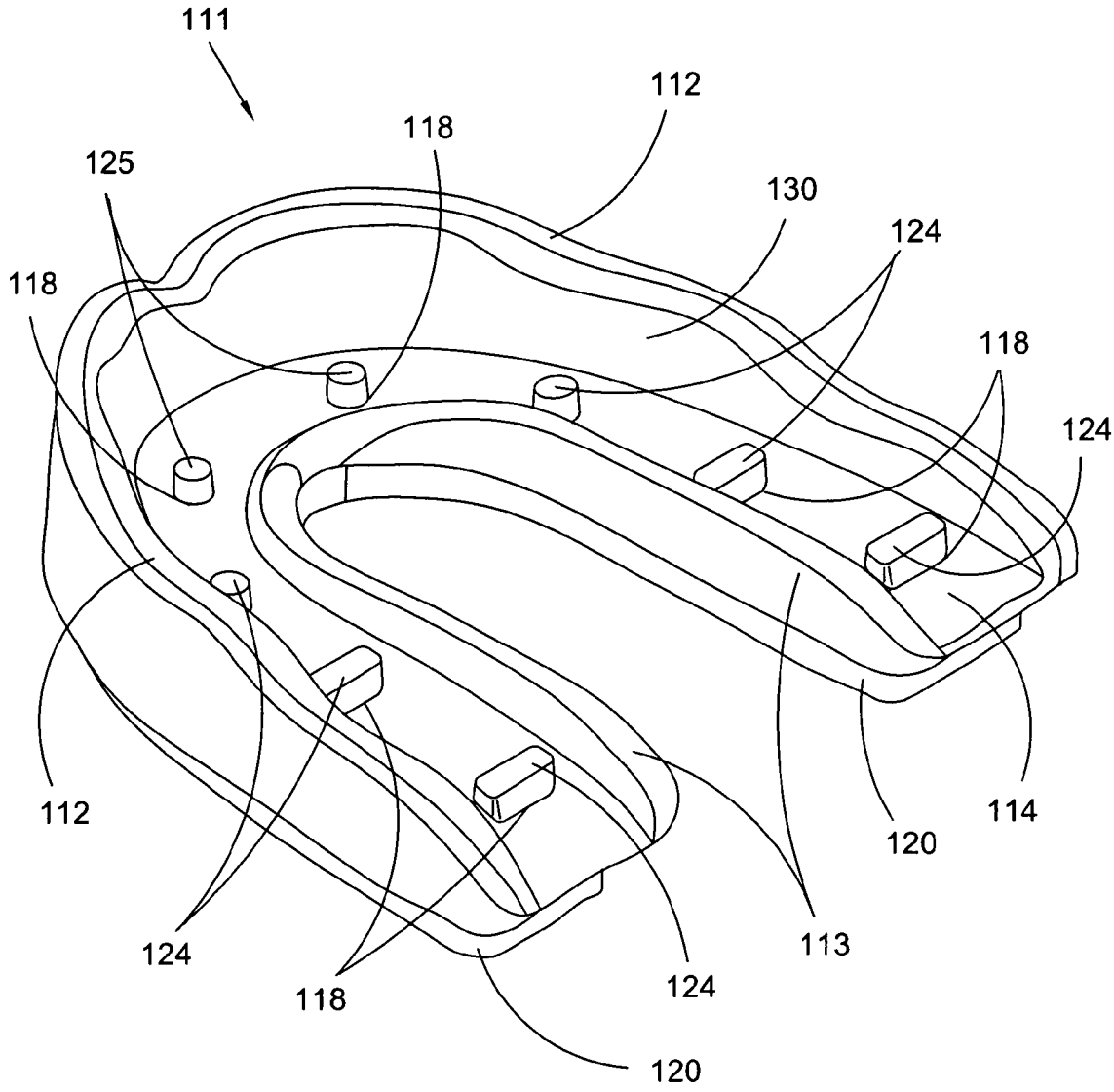
FIG. 11 is a top perspective view of the alternate embodiment of the mouthguard of the present invention showing posts extending from the platform into the u-shaped channel.

FIG. 11 is a top perspective view of mouthguard 100 showing posts 124 extending from platform 120 through holes 118 into the u-shaped channel as seen through filler 130. As described below, posts 125, positioned in the front of mouthguard 100 at the curve of the u-shaped platform 120, are specifically shaped to receive header 142.

Figure 12:
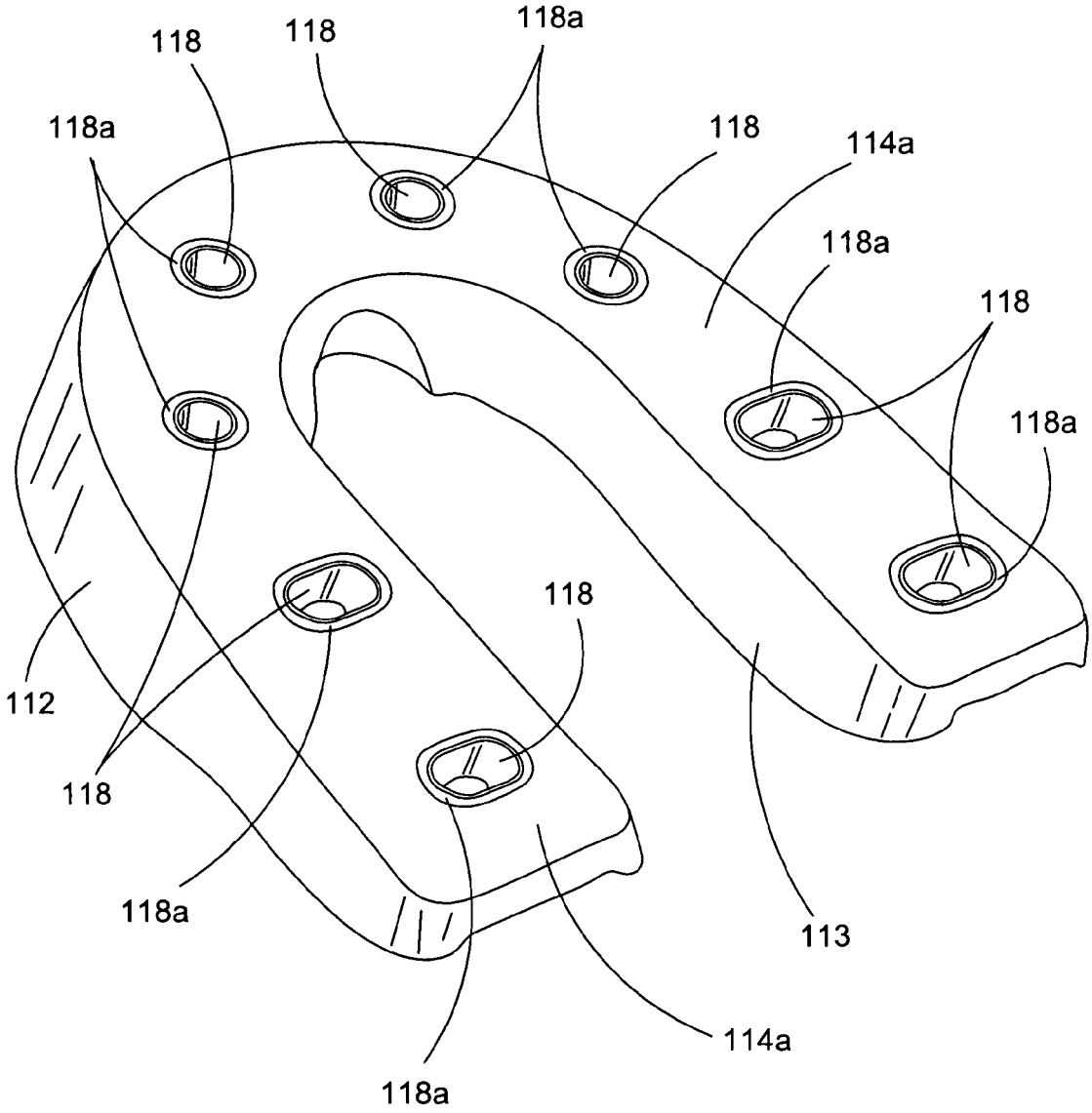
FIG. 12 is a bottom perspective view of the bottom surface of the upper portion of the alternate embodiment of the mouthguard.
Figure 13:
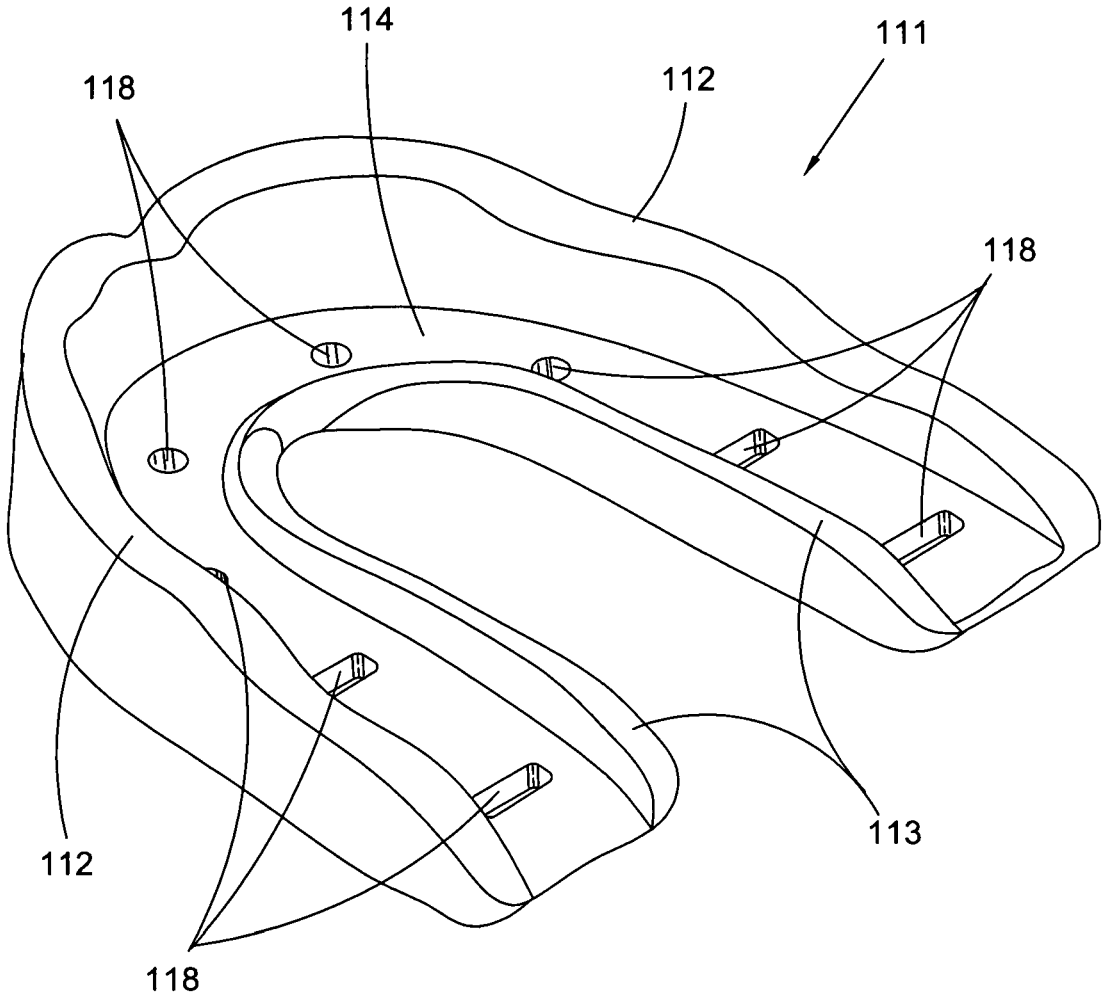
FIG. 13 is a top perspective view of the upper portion of the alternate embodiment of the mouthguard.

FIG. 12 is a bottom perspective view of the bottom of upper portion 111. Similar to mouthguard 10 discussed above, bottom surface 114*a* of floor 114 defines holes 118. Grooves 118*a* surround the perimeter of holes 118. FIG. 13 is a top perspective view of upper portion 111 of mouthguard 100. Similar to holes 18 of mouthguard 10, holes 118 are preferably shaped to receive posts 124 having a complementary shape in order to create a snug fit when platform 120 is joined to upper portion 111.

Figure 14:
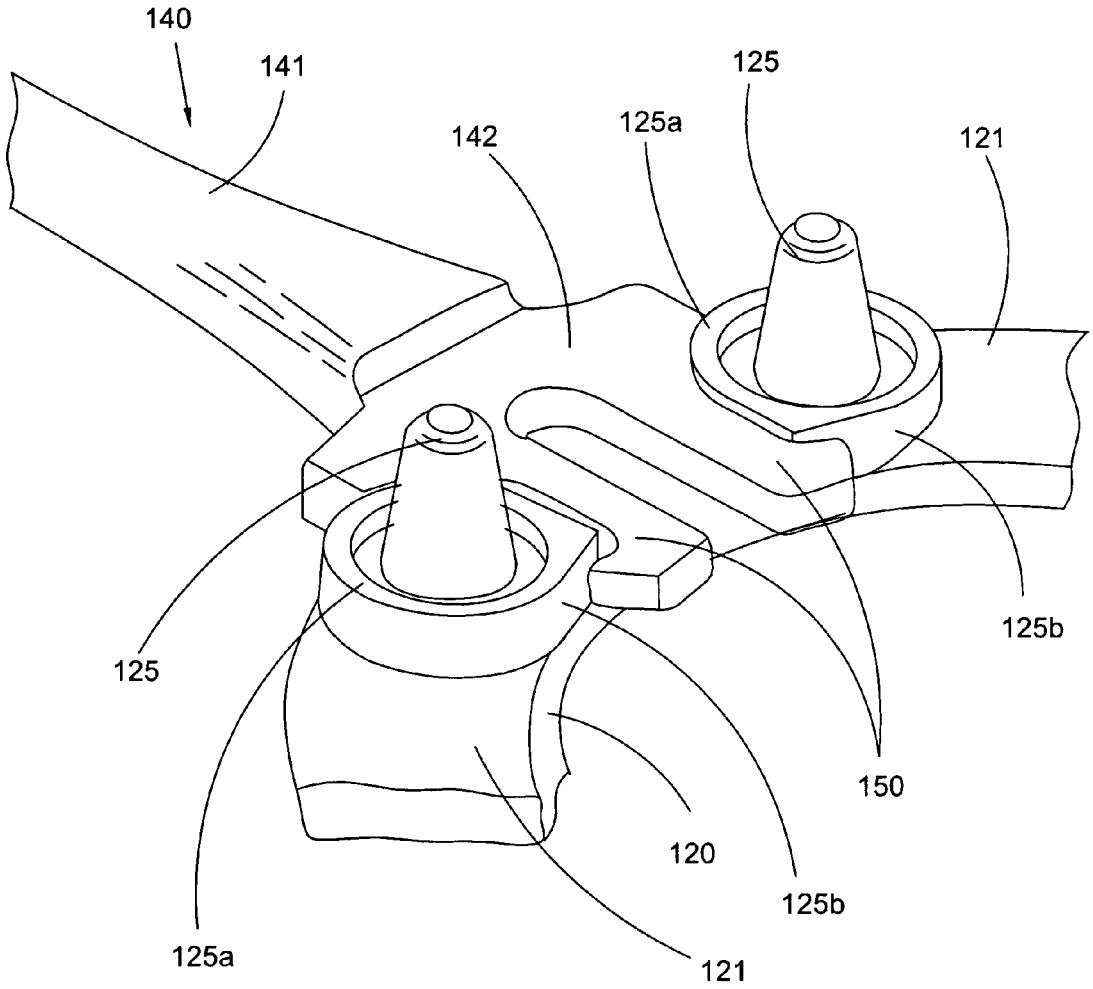
FIG. 14 is a top perspective view of one mode for attaching the strap to the alternate embodiment of the mouthguard.
Figure 15:
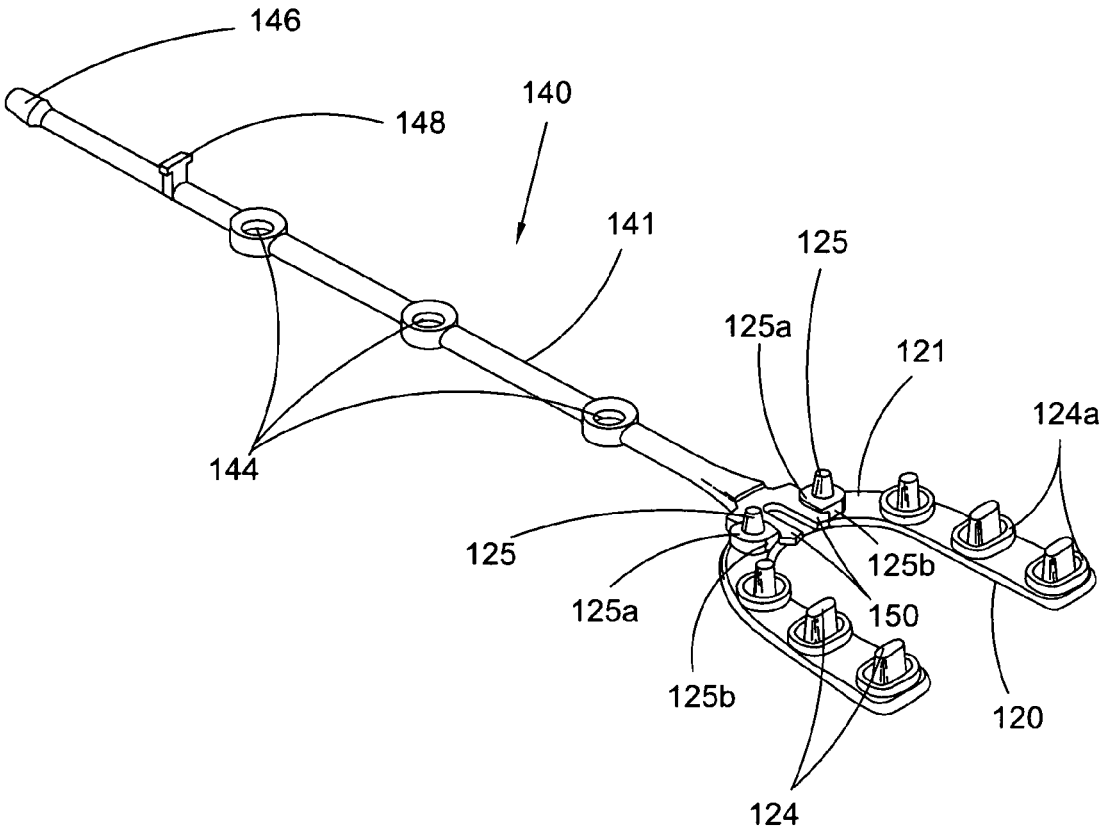
FIG. 15 is a top perspective of view of the alternate embodiment of the mouthguard of the present invention showing the strap extending from the platform and attached to post undercuts by prongs formed from the strap header.

FIG. 14 is a top perspective view of an alternate mode for attaching strap 140 to mouthguard 100. Header 142 includes two prongs 150 shaped to fit closely around undercuts 125*a* that each surround posts 125. Preferably, undercuts 125*a* are shaped so that prongs 150 are attached by snapping them into position to form a tight fit. For example, as seen in FIG. 14, undercuts 125*a* include a flat facing 125*b* shaped to conform to the shape of prongs 150. In an alternate embodiment, prongs 150 may be configured or sized to be about as thick as undercuts 124*a* surrounding posts 124 on platform 120 and may be attached directly to posts 125. The added thickness would enable prongs 150 to act similar to undercuts 124*a* to form gaps or air cushions 126 (not seen in FIG. 14). FIG. 15 is a top perspective of view of mouthguard 100 showing strap 140 extending from platform 120 and attached to undercuts 125*a* by prongs 150. It will be recognized by those skilled in the art that other attachment designs may be used to attach strap 140 to posts 125 and/or undercuts 125*a*.

Figure 16:
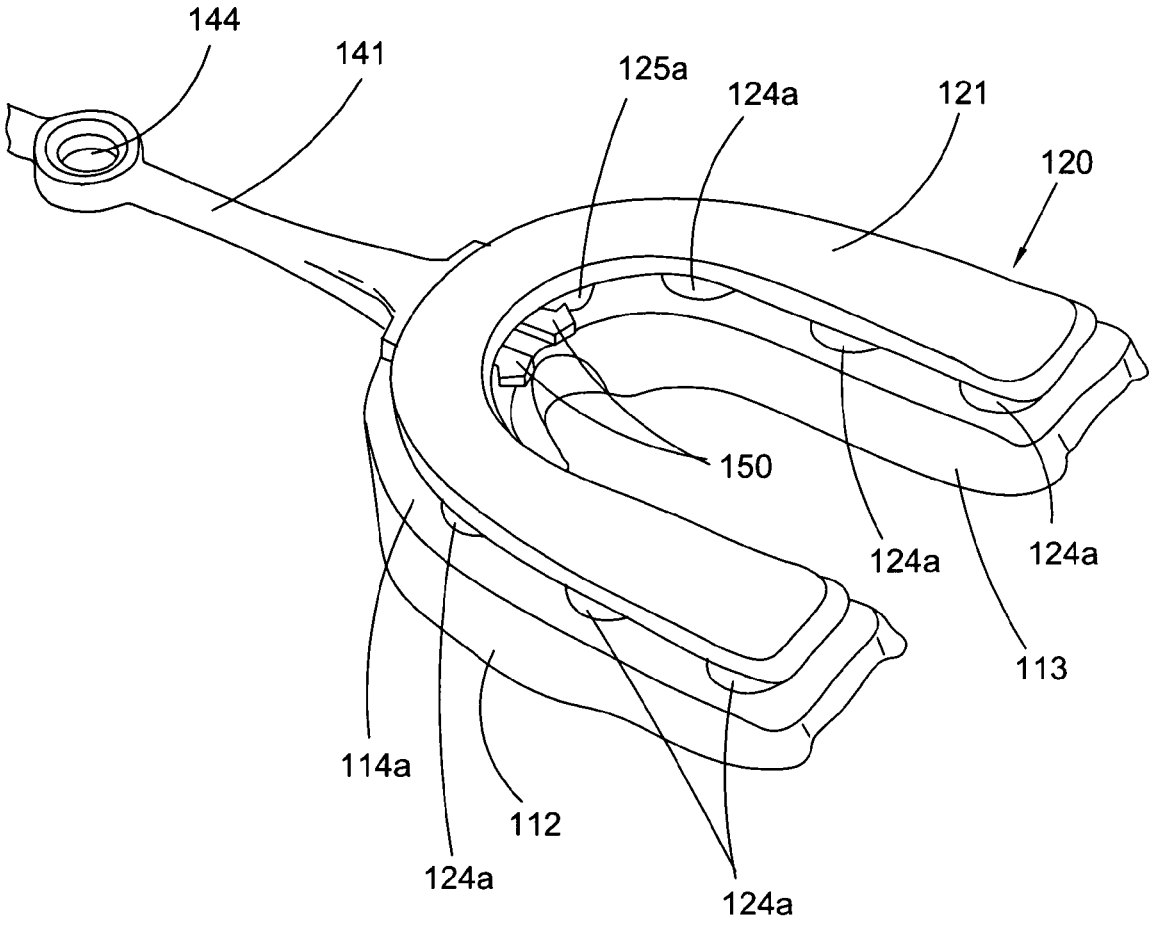
FIG. 16 is a bottom perspective view of the alternate embodiment of the assembled mouthguard in which the strap is attached to the undercuts surrounding the front posts of the u-shaped platform.
Figure 17:
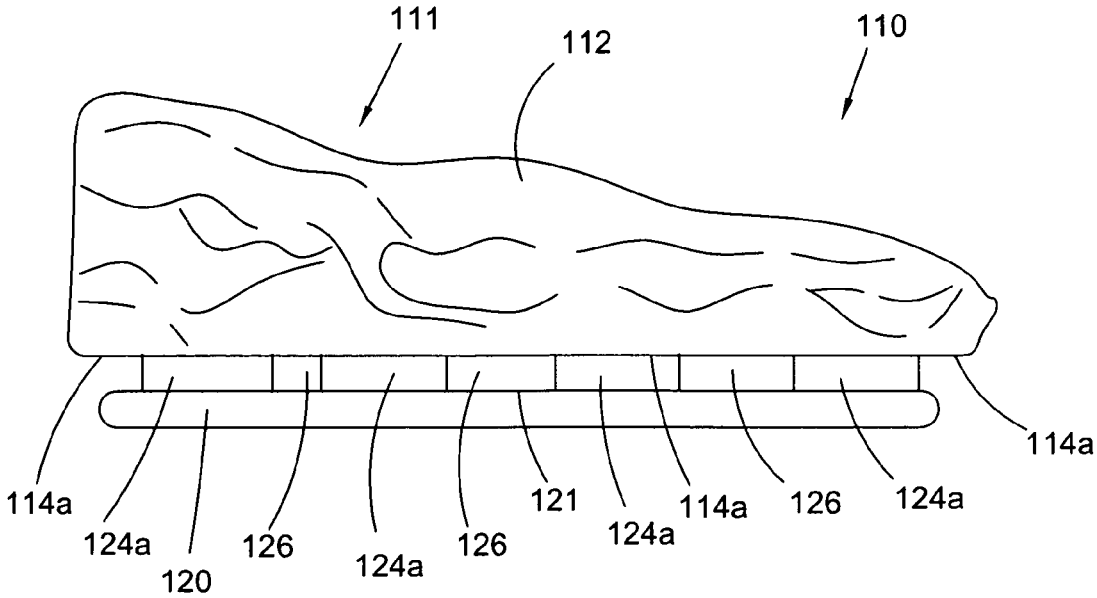
FIG. 17 is a side view of a variation of the alternate embodiment of the mouthguard in which the strap is not attached.

FIG. 16 is a bottom perspective view of assembled mouthguard 100 in which strap 140 is attached to undercuts 125*a* using prongs 150. Platform 120 is attached to upper portion 111 similar to mouthguard 10 in that posts 124 and 125 are pushed through holes 118 in upper portion 111. In the preferred embodiment shown, undercuts 124*a* and 125*a* fit into one or more of grooves 118*a*. Prongs 150 of strap header 142 are fit next to or around undercuts 125*a* and held in placed by a snap-fit or other suitable attachment method. By snap-fit is meant that prongs 150 and/or posts 125 or undercuts 125*a* are sized to require a slight flexion to fit prong 150 around an undercut or post. After placing it around a post or undercut, prong 150 will attempt to flex back to its original shape, thereby forcing a tight fit with either post 125 or undercut 125*a*. FIG. 17 is a side view of another embodiment of mouthguard 100 in which strap 140 is not attached. Similar to mouthguard 10 discussed above, mouthguard 100 may be assembled and molded with or without strap 140. In both modes, assembled mouthguard 100 includes gaps 126 between undercuts 124*a* and/or undercuts 125*a*. Similar to mouthguard 10, gaps (air cushions) 126 are defined by undercuts 124*a* and/or 125*a* (not seen in FIG. 17), platform base 121, and undersurface 114*a*. In a different embodiment, posts 124 and/or 125 may replace undercuts 124*a* and/or 125*a*.

A method similar, if not identical, the assembly and molding method for mouthguard 10 is used to shape mouthguard 100. As with mouthguard, the same method is used when strap 140 is attached to front undercuts 125*a*. Upper portion 111 and platform 120 are pressed together as described above with or without strap 140. Before placing assembled mouthguard 100 into the boiling or near boiling water, strap 140 is attached to posts 125 or undercuts 125*a*. Using strap 140 as a handle, if attached, mouthguard 100 is dipped into the boiling or near boiling water for about 30 seconds, excess water is shaken off after which the wearer bites down on the softened mouthguard 10 to form it into the shape of the wearer's mouth. Preferably heat is removed form boiling water for about 30 seconds before mouthguard is placed in the water. Because header 142 is softened with upper portion 111 and platform 120, upper portion 111 and platform 120 are molded around header 142 to fixedly or permanently attach strap 140 to mouthguard 100.

Figure 18:
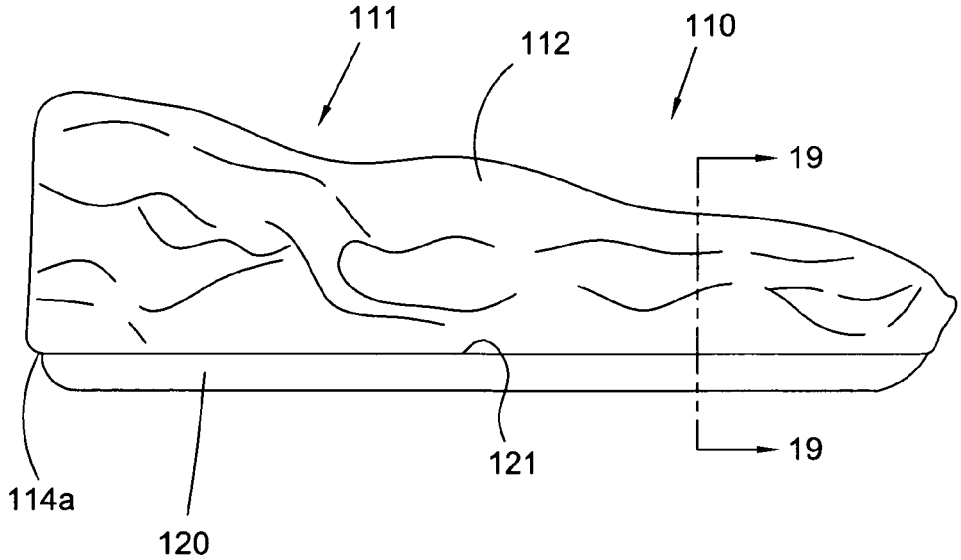
FIG. 18 is a side view of mouthguard 100 after the molding process is performed; and, FIG. 19 is a cross section view of mouthguard 100 taken along 19-19 of FIG. 18 showing an air cushion enclosed within the molded mouthguard.
Figure 19:
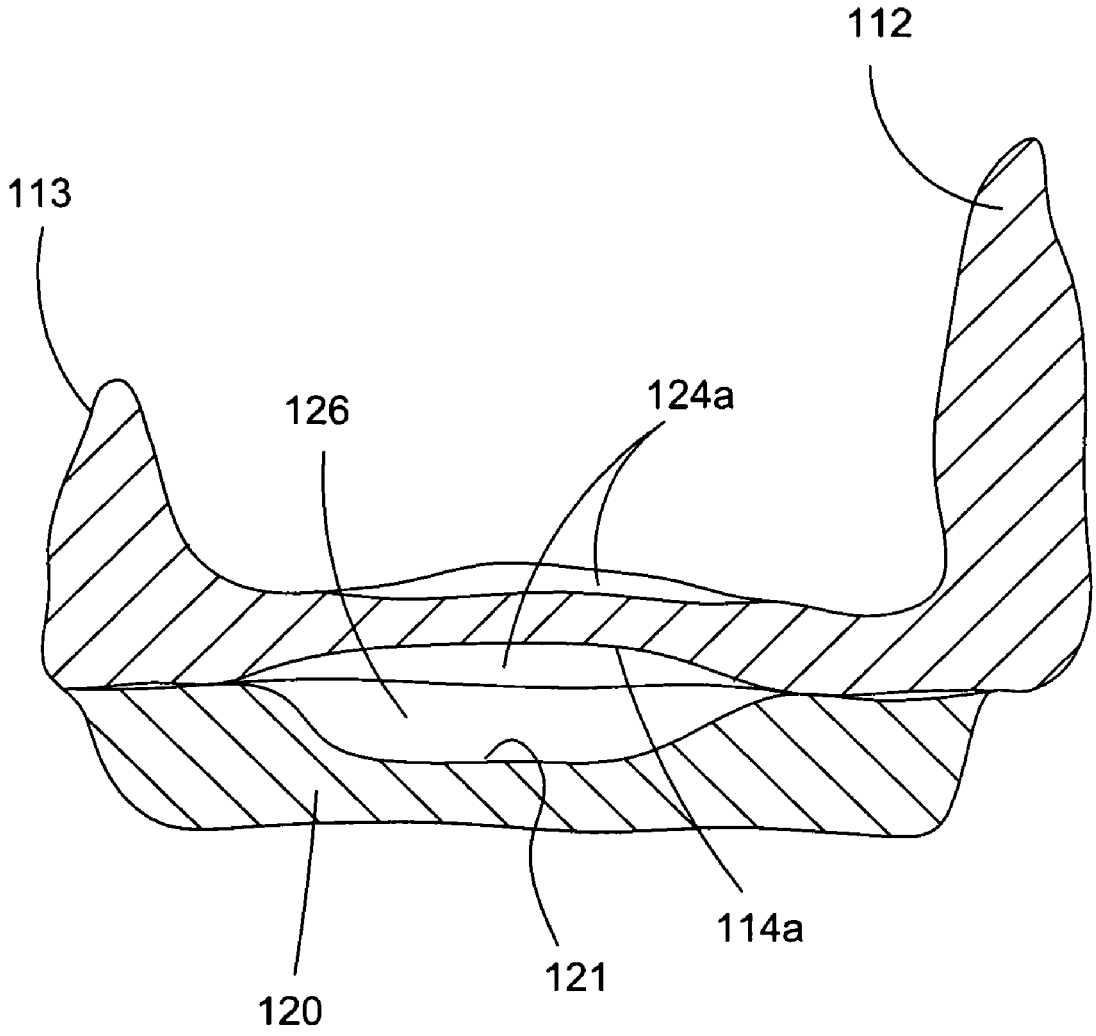

FIG. 18 is a side view of mouthguard 100 after the molding process is performed. The material used to fabricate the mouthguard is softened sufficiently to compress the posts and/or undercuts so that air cushions are enclosed by upper portion 111 and platform 120. FIG. 19 is a cross section view of mouthguard 100 taken along 19-19 of FIG. 18. The cross section is taken through one of air cushions 126 after the molding (fitting) process. Air cushion 126 is present after fitting and is enclosed by compressed undercut 124*a*, bottom surface 114*a*, and base 121. Mouthguard 10 and air cushions 26 are compressed in a similar manner during the fitting process.

Although a variety of materials may be used to fabricate mouthguards 10 and 100, ethyl vinyl acetate (EVA) is preferred as it readily softens in boiling water and remains soft after water immersion for a sufficient time to allow molding in the wearer's mouth to occur. In a more preferred embodiment, the material for fillers 30 and 130 is made from a softer or "low melt" grade of EVA than upper portions 11 and 111 and platforms 20 and 120. Other materials that may be used in a similar manner include Kraton styrene polymer material, PVC, and ENGAGE™, a polyethylene polymer product produced by Dow Chemical.

Thus it is seen that the objects of the invention are efficiently obtained, although changes and modifications to the invention should be readily apparent to those having ordinary skill in the art, which changes would not depart from the spirit and scope of the invention as claimed.

We claim:

1. A mouthguard comprising:

an upper portion in the form of a u-shaped channel having an inner wall, an outer wall and a floor, said floor of said u-shaped channel defining a plurality of holes;

a lower platform having a u-shaped base and a plurality of posts distributed on said u-shaped base and extending therefrom; and, a filler material molded to the inside of said u-shaped channel of said upper portion;

wherein said each of said plurality of posts is aligned with one of said plurality of holes such that at least a portion of the length of each of said plurality of said posts extends through said aligned hole when said lower platform is joined with said upper portion;

at least one undercut segment in direct contact with and extending from said u-shaped base of said lower platform and surrounding at least one of said plurality of posts and wherein each of said at least one undercut segments is positioned between said upper portion and said base of said lower platform when said lower platform is joined with said upper portion;

wherein the height of said at least one of said plurality of posts measured from said u-shaped base of said lower platform to the end of said at least one post of said plurality of posts is higher than the height of said at least one undercut segment that surrounds said at least one of said plurality of posts measured from said u-shaped base of said lower platform;

at least one perimeter groove, wherein each of said at least one perimeter grooves is cut into said bottom surface of said floor of said upper portion around one of said plurality of holes so as to surround one of said plurality of holes, each of said at least one perimeter grooves having a depth less than said each one of said plurality of holes such that each of said at least one undercut segments fits into one of said at least one perimeter grooves when said lower platform is joined with said upper portion;

wherein a groove is molded into a bottom surface of said floor of said u-shaped channel of said upper portion.

2. The mouthguard as recited in claim 1 further comprising an attachment strap, said attachment strap having a header at one end of said strap wherein said header is shaped to fit into said groove between said upper portion and said lower platform, wherein said attachment strap is attached to said mouthguard when said lower platform is joined to said upper portion.

3. The mouthguard as recited in claim 2 wherein said attachment strap defines a plurality of strap holes distributed along the length of said strap and includes at least one leader at the other end of said strap configured to fit through at least one of said plurality of strap holes.

4. The mouthguard as recited in claim 1 further comprising an attachment strap, said attachment strap having a header at one end of said strap wherein said header is shaped to attach to at least one of said plurality of posts.

5. The mouthguard as recited in claim 4 wherein said header is shaped to attach to said at least one post using a snap fit.

6. The mouthguard as recited in claim 5 wherein said shaped header comprises two prongs wherein each of said two prongs is shaped to attach to a separate one of said plurality of posts.

7. The mouthguard as recited in claim 1 further comprising an attachment strap, said attachment strap having a header at one end of said strap wherein said header is shaped to attach to at least one of said plurality of undercut segments.

8. The mouthguard as recited in claim 7 wherein said header is shaped to attach to said at least one undercut segment using a snap fit.

9. The mouthguard as recited in claim 8 wherein said shaped header comprises two prongs wherein each of said two prongs is shaped to attach to a separate one of said plurality of posts.

10. The mouthguard as recited in claim 1 wherein said upper portion and lower platform are each fabricated from ethylene vinyl acetate.

11. The mouthguard as recited in claim 10 wherein said filler material is softer than said upper portion and said lower platform.

12. The mouthguard as recited in claim 11 wherein said softer material is ethylene vinyl acetate.

13. The mouthguard as recited in claim 1 wherein at least one air cushion is formed between two posts.

14. The mouthguard as recited in claim 13 wherein said at least one air cushion comprises a plurality of air cushions.

15. The mouthguard as recited in claim 1 wherein at least one air cushion is formed between two succeeding undercut segments.

16. The mouthguard as recited in claim 15 wherein said at least one air cushion comprises a plurality of air cushions.

* * * * *